United States Patent [19]

Kraeutler

[11] Patent Number: 4,727,919

[45] Date of Patent: Mar. 1, 1988

[54] SAFETY AND EMERGENCY ACTUATOR DEVICE FOR A CONCERTINA TYPE DOOR

[75] Inventor: Bernard Kraeutler, Dunieres, France

[73] Assignee: Nergeco, Dunieres, France

[21] Appl. No.: 795,957

[22] Filed: Nov. 7, 1985

[30] Foreign Application Priority Data

Nov. 7, 1984 [FR] France ..... 84 16949

[51] Int. Cl.[4] ..... E05F 15/00

[52] U.S. Cl. ..... 160/84 R; 160/8; 160/9; 160/298; 160/310

[58] Field of Search ..... 160/84 R, 133, 170, 160/190, 298, 310, 1, 7–9, DIG. 16

[56] References Cited

U.S. PATENT DOCUMENTS

| | | | |
|---|---|---|---|
| 66,995 | 7/1867 | Smith | 160/298 |
| 1,876,798 | 9/1932 | Triller | 160/190 |
| 2,083,726 | 6/1937 | Mason | 160/298 |
| 2,149,481 | 3/1939 | Van Bosch et al. | 160/170 |
| 2,362,789 | 11/1944 | Workman | 160/190 |
| 2,670,065 | 2/1954 | Stevens, Jr. | 160/310 |
| 3,134,427 | 5/1964 | Landenberger | 160/DIG. 16 |
| 3,421,568 | 1/1969 | Youngs | 160/310 |
| 3,603,372 | 9/1971 | Dietzsch | 160/170 |
| 3,853,167 | 12/1974 | Wardlaw | 160/133 |
| 3,878,879 | 4/1975 | Manns | 160/133 |
| 3,915,377 | 10/1975 | Sutton, Jr. | 160/9 |
| 3,973,173 | 8/1976 | Smith | 160/9 |
| 3,981,343 | 9/1976 | Devito | 160/9 |
| 4,037,526 | 7/1977 | Tackle | 160/310 |
| 4,130,156 | 12/1978 | Wardlaw | 160/9 |
| 4,397,347 | 8/1983 | Brabant | 160/84 R |
| 4,404,768 | 9/1983 | Cristy | 160/8 |
| 4,428,278 | 1/1984 | Sutton, Jr. | 160/9 |

FOREIGN PATENT DOCUMENTS

| | | | |
|---|---|---|---|
| 968377 | 5/1975 | Canada | 160/1 |
| 2814345 | 10/1979 | Fed. Rep. of Germany | 160/84 R |
| 2410117 | 7/1979 | France | 160/84 R |

*Primary Examiner*—Gary L. Smith
*Assistant Examiner*—Eric K. Nicholson
*Attorney, Agent, or Firm*—Sughrue, Mion, Zinn, Macpeak and Seas

[57] ABSTRACT

A counterweight (12) provided at the end of a shaft (8) for winding up the door-raising belts (3) of a concertina type door. The counterweight (12) is designed to open the door to a fraction of its height. It co-operates with the motor (7) when the door is being opened and closed under normal circumstances. A motor and brake unit (14) is provided including both the motor (7) and a brake for locking the shaft (8) when the motor is not in operation. Catch means may also be provided on the bottom of the door. Manual means are provided for releasing the shaft-locking brake means in the event of a power failure. The device is essentially a safety device and in the event of a motor breakdown or a power failure it enables the concertina-type door to be rapidly opened, at least partially. Similarly, in the event of the coupling between the drive shaft and the motor being broken, the device prevents the door from falling to its closed position in a catastrophic manner. The device also makes it possible to use a motor of smaller power than would be required in an installation which does not include a counterweight.

3 Claims, 11 Drawing Figures

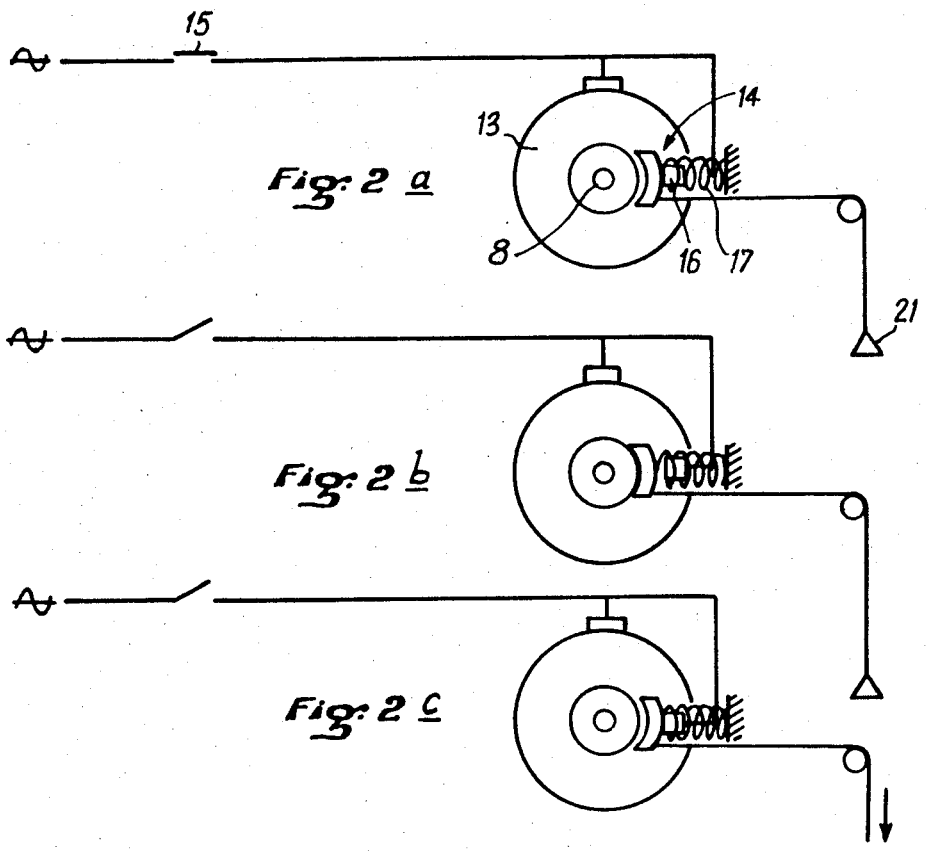
Fig: 2 a
Fig: 2 b
Fig: 2 c
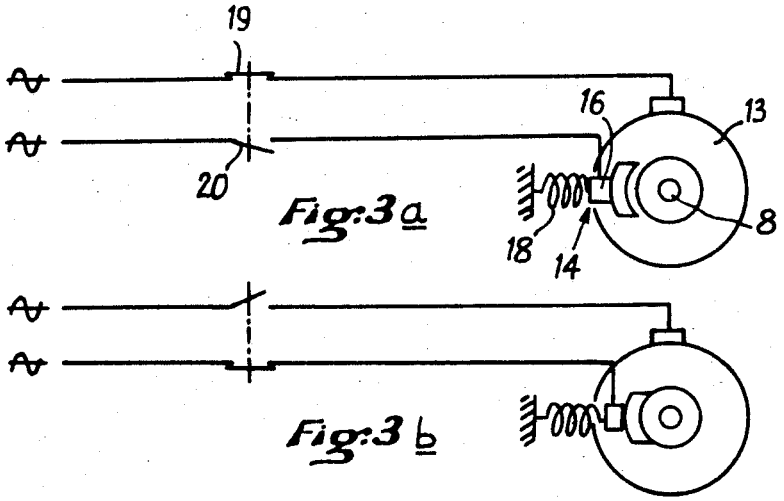
Fig: 3 a
Fig: 3 b

Fig. 4 a
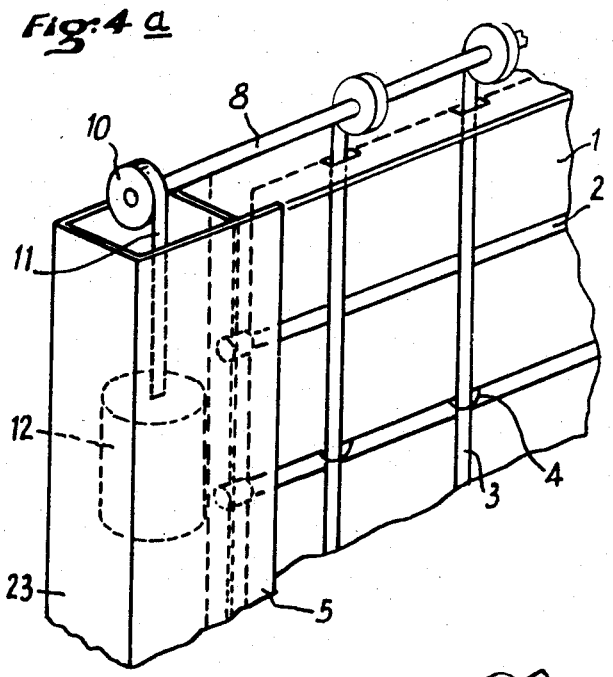
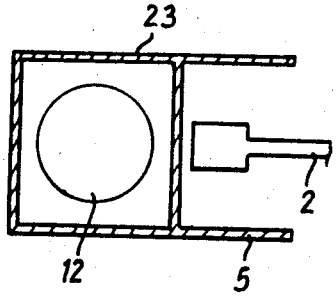
Fig. 4 b
Fig. 5 a
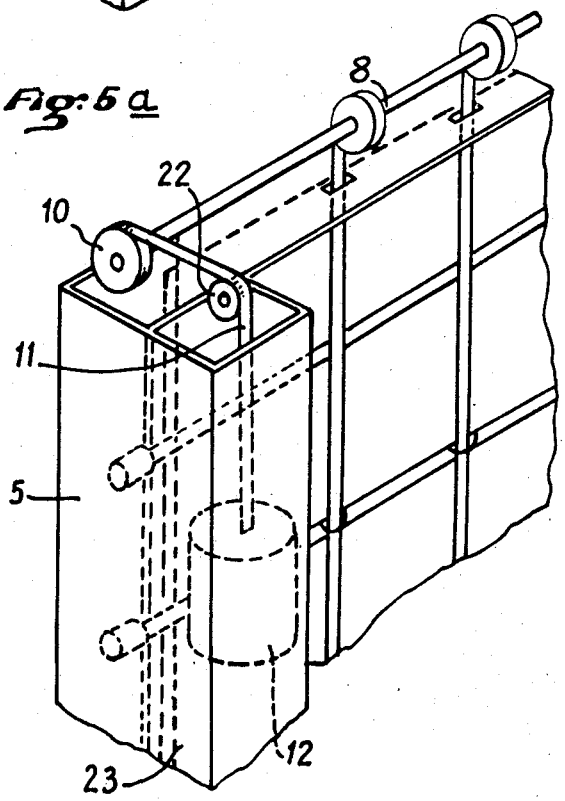
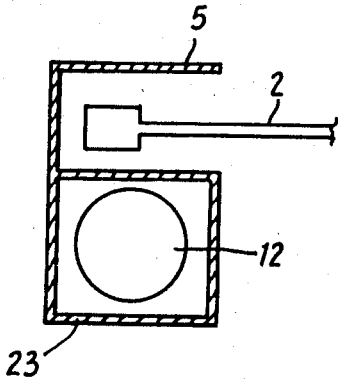
Fig. 5 b

SAFETY AND EMERGENCY ACTUATOR DEVICE FOR A CONCERTINA TYPE DOOR

The present invention relates to a safety and emergency actuator device for a concertina type door.

BACKGROUND OF THE INVENTION

Concertina type doors of large size are commonly used in industrial premises. In outline, such doors comprise a horizontally stiff flexible curtain constituted either by a series of hinged horizontal panels or else by a flexible sheet which is stiffened at regular intervals by horizontal stiffener rods. In both cases, door-lifting belts are fixed to the bottom of the curtain and preferably pass through guides fixed along the curtain e.g. on the hinges of some of the panels or on some of the stiffener rods. A main or belt-winding shaft runs over the top of the door for winding up the belts under electric motor drive, said shaft including brake means for locking it in position when the motor is not in operation. The motor and the brake means are commonly constituted by a combined motor and brake unit.

In present installations, if the motor is out of service (e.g. because of a breakdown or because of a power cut) and the door is closed, the door can be raised (once the brake has been released) only by means of a manually controlled emergency device comprising a handle, a shaft rotatable by the handle, and an angle coupling to enable the emergency handle to be used to rotate the main shaft and thus wind up the belts. Since large doors are heavy, such an emergency device needs to have a considerable gear reduction ratio, and as a result raising the door takes a long time. Thus, in situations which require the door to be opened quickly, e.g. to evacuate the building or to allow emergency services into the building, this type of emergency control device is inadequate. Furthermore, in current installations, when the door is open or while the door is opening, if an accident takes place which disconnects the main belt-lifting shaft from the motor and brake unit, then the curtain drops immediately under its own weight, and thus represents a potential hazard.

Preferred implementations of the present invention provide a safety and emergency actuator device for a concertina type door and suitable for preventing the door from suddenly dropping shut and also suitable for rapidly opening the door, at least partially.

SUMMARY OF THE INVENTION

A device in accordance with the present invention includes one or more counterweights of sufficient mass to prevent the curtain from falling to the fully closed position should the main door-lifting shaft become disconnected from its drive motor, the mass of the counterweight(s) being sufficient to partially raise the curtain should the motor be out of service, the device further including means for releasing the door-lifting shaft from the brake means to enable the door to be lifted by the counterweight(s) when the drive motor for said shaft is not in operation.

The counterweight(s) is/are preferably designed to cooperate with the drive motor during normal opening and closing operations of the concertina type door. Depending on whether the brake means for the main belt-lifting shaft are constituted by a motor and brake unit or by a catch situated on the bottom stiffener rod, the lifting provided by the counterweight(s) is controlled by manual means for releasing said motor and brake unit or for disengaging said catch.

The, or each, counterweight is preferably free to move inside a housing placed adjacent to one of the door risers, said housing either being in the same plane as the door, or else projecting from the door in an inwards or in a outwards direction.

BRIEF DESCRIPTION OF THE DRAWINGS

Embodiments of the invention are described by way of example with reference to the accompanying drawings, in which:

FIG. 2 is a simplified circuit diagram showing three operative states of an embodiment of the invention in which the brake of the motor and brake unit is engaged when the unit is disconnected from its supply of electricity: a shows the motor in operation with the brake disengaged; b shows the motor disengaged and the brake engaged; and c shows the motor out of service and the brake manually disengaged;

FIG. 3 is a simplified circuit diagram showing two operative states of an embodiment of the invention in which the brake of the motor and brake unit is released and unpowered when the motor is powered (FIG. 3 *a*) and in which the brake is powered and engaged when the motor is unpowered (FIG. 3 *b*);

FIG. 4 *a* is a simplified perspective view of a portion of a first type of door riser including a protective housing for a counterweight in accordance with the invention, and FIG. 4 *b* is a diagrammatic horizontal section through said riser; and FIG. 5 *a* is a simplified perspective view of a portion of a second type of door riser including a protective housing for a counterweight in accordance with the invention, and FIG. 5 *b* is a diagrammatic horizontal section through said riser.

MORE DETAILED DESCRIPTION

Figure 1B:
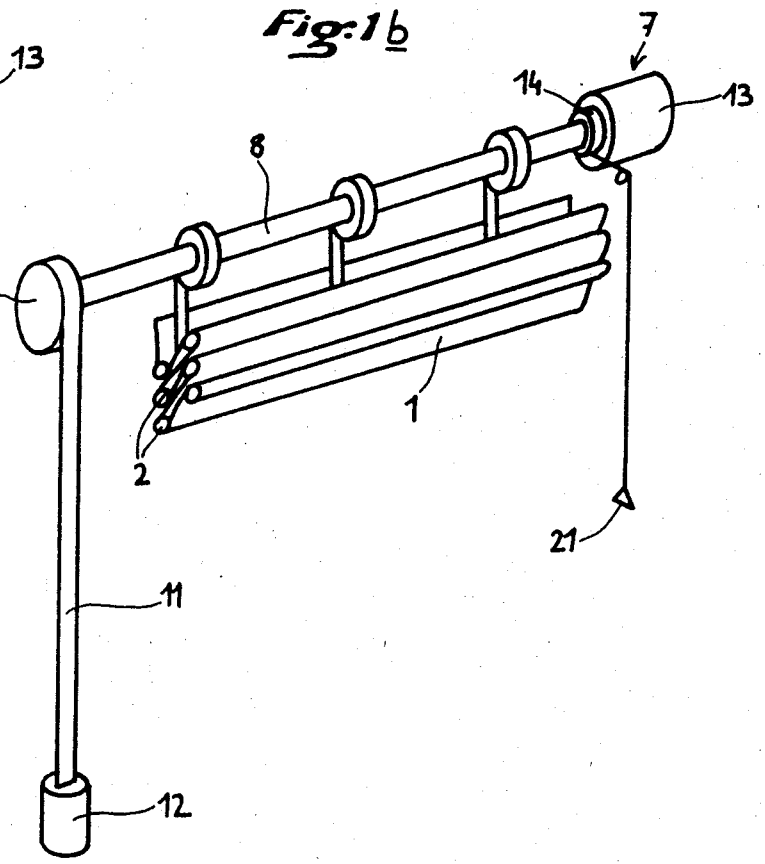
FIG. 1 is a simplified perspective view of a first embodiment of the invention showing the door in the closed position at a and in the raised position at b.
Figure 1A:
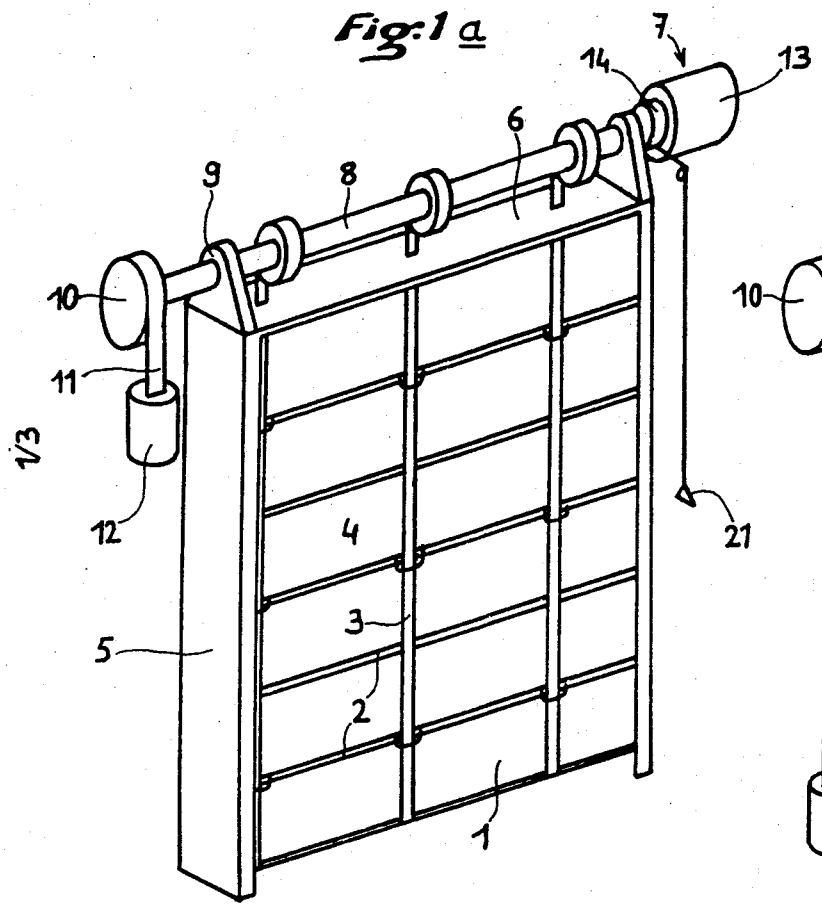

FIG. 1 shows a concertina type door including a horizontally stiff flexible curtain 1 in the form of a flexible sheet with horizontal stiffener rods 2, lifting belts 3 which are fixed to the bottom rod and which pass through guides 4 fixed on some of the other rods, channel section risers 5 in which the ends of some of the rods are slidably received, a lintel-forming beam 6 having a motor and brake unit 7 fixed thereon to drive a main shaft 8 for winding up the belts, and bearings 9 for supporting said shaft.

In accordance with the present invention, a drum 10 is placed at one end of the shaft 8 and has a cable 11 wound thereon (or any other suspension means such as a belt, a cord, a chain, . . . ) with the other end of the cable being attached to a counterweight 12 in such a manner that the said counterweight is in its high position when the door is closed (FIG. 1 *a*) and in its low position when the door is opened (FIG. 1*b*). The couple exerted by the counterweight 12 on the shaft 8 via the drum 10 depends both on the mass of the counterweight 12 and on the diameter of the drum 10. The counterweight system is designed in such a manner as to ensure that the door is capable of being opened over a predetermined fraction of its height under the sole driving force of the counterweight in the event that the motor 7 is not in operation and the brake means are disengaged. The counterweight 12 then occupies an intermediate position between its high position which it occupies when the door is completely closed (FIG. 1 *a*) and its low position which it occupies when the door is completely opened (FIG. 1 *b*). Once the required force has been found, the appropriate mass for the counterweight 12 and diameter for the drum 10 are chosen taking account of: the space that they will occupy; the stroke of the counterweight between its high position and its low position; the mechanical stresses applied to the main shaft; etc. In order to satisfy these various requirements, it may be necessary to provide a system including two counterweights, placed at respective ends of the main shaft, thereby balancing the forces applied thereto.

The couple exerted on the shaft 8 by the counterweight intervenes under three types of circumstance: when the main shaft is disconnected from the motor and brake unit with the door in the open position or with the door being opened; when the motor and brake unit is out of service and the door is closed; and during normal operation of the motor and brake unit.

When the main shaft becomes accidentally disconnected from the motor and brake unit (which usually happens when the direction of shaft rotation is reversed) the curtain tends to drop under the effect of its own weight (including the weight of the stiffener rods). In this event, the counterweight acts as a safety device which is specific to this type of door. If the shaft breaks (or any other equivalent accident occurs) when the bottom of the curtain is at a greater height than the above-defined predetermined fraction of its open height corresponding to equilibrium between a portion of the weight of the curtain and the counterweight, then the curtain comes down with decreasing speed until it reaches said predetermined height. Otherwise, if the curtain is not already that high, then it rises with decreasing speed until it reaches the predetermined height.

In either case the counterweight prevents the curtain from completely closing and avoids any risks of accidents to personnel which could result from the door dropping shut.

When the door is closed and the motor is out of service, either because of a breakdown or because of a power cut, the door can be opened over the said fraction of its height simply by unlocking the main shaft (which is normally permanently locked except when the motor is in operation). Such manual shaft unlocking can be performed in various different ways, depending on the nature of the brake means normally employed for locking the shaft.

In the embodiment shown in FIG. 2, the motor 13 and the brake 14 of the motor and brake unit are powered together. When the switch 15 is closed (see FIG. 2 *a*) the motor 13 operates and the brake 14 is released (the brake generally comprises an electromagnet 16 and a compression spring 17, with the force exerted by the electromagnet 16 being greater than and opposite to the force which is exerted by the compression string 17). When the switch 15 is open (FIG. 2 *b*) the motor 13 does not operate and the brake 14 locks the shaft under the effect of the compression spring 17. In the event of motor breakdown or of a power cut (e.g. due to normal Fire Service procedure of cutting power to a building which is on fire) the motor and brake unit is in the same situation as if it were switched off. In order to release the main shaft, i.e. to make it possible to open the door under the effect of the counterweight 12, the brake compression spring is compressed by manually controlled means 21.

In another embodiment of the invention, the means for unlocking the shaft 8 are quite different, and in particular action is no longer taken on the brake of a motor and brake unit but rather on a locking catch belonging to the bottom stiffener rod. This embodiment applies to a motor and brake unit which is operated differently from that described above. FIG. 3 shows this new arrangement: when the motor 13 is powered, the brake 14 (which may include an electromagnet 16 and a return spring 18) is not powered (FIG. 3 *a*), and vice versa (FIG. 3 *b*). When the switch 19 is closed and the switch 20 is opened (FIG. 3 *a*) the motor 13 is in operation and the return spring 18 keeps the brake in the released position. When the switch 19 is opened and the switch 20 is closed (FIG. 3 *b*) the motor 13 is not in operation and the electromagnet 16 is powered, and generates a force greater than the force provided by the return spring 18, thus applying the brake. If there is a power cut, the brake is released and the door would rise automatically if door-latching means were not provided. When the motor and brake unit is operated in this way, latching means must be provided, for example on the bottom rod of the door to engage fixed means which are level with said rod when at ground level. Thus, in the event of a power cut, the door catch can be released either by hand or by foot in order to allow the door to be raised by the counterweight.

In accordance with the present invention, the couple exerted by the counterweight 12 and the drum 10 cooperates with the motor during normal operation, i.e. the couple is not applied only under the above-mentioned special conditions of the main shaft becoming disconnected from the motor and brake unit or of the said unit being out of service. When the door is opened, the counterweight assists in raising the curtain, so the motor only needs to provide work from the moment when the weight of the lifted portion of the curtain comes into equilibrium with the counterweight. Similarly, on closing the door, the motor only needs to provide work when lifting the counterweight from its equilibrium position up to its high position. An installation which includes a counterweight can therefore be equipped with a less powerful motor than an installion which does include a counterweight.

Thus, the counterweight plays a useful role both in normal operation and in emergency operation. It is therefore essential to ensure that nothing can impede free displacement of the counterweight. This criterion is satisfied in accordance with the invention by locating the counterweight in a housing which is disposed against one of the door risers. The housing should be made of strong material, such as metal or plastic, it should be of circular or polygonal section, and its height should be substantially equal to the stroke of the counterweight. Advantageously, the housing and the door riser are made as one part. FIGS. 4 and 5 show two types of riser embodying this principle. For example, a channel section metal bar constituting a door riser 5 and serving as a guide for the flexible curtain 1, may have a second channel-section bar 23 fitted thereto, e.g. by welding, so as to delimit a box section inside which the counterweight 12 is free to move unhindered. In the FIG. 4 example, the counterweight housing is made up of a channel section bar 23 which is welded to the web of the door riser 5. The housing thus lies in the same plane as the door, and thus adds to the overall width of the door assembly. In the FIG. 5 embodiment, the counterweight housing is made up of a channel section bar welded to one of the flanges of the door riser 5. In this case the housing does not extend the width of the door, but projects inwardly or outwardly therefrom. In both embodiments the open slot along one face of the channel section bar 23 is closed by the portion of the door riser 5 to which it is welded. Since the counterweight 12 is not directly below the drum 10 in the FIG. 5 embodiment, its belt 11 passes over an additional pulley wheel 22.

The present invention is not limited to the specific embodiments described above, and numerous variations lie within the competence of persons skilled in the art.

I claim:

1. A safety and emergency actuator device for a concertina type door, comprising:

a flexible curtain stiffened at regular intervals by horizontal stiffener rods and guided between two door risers;

door-lifting belts fixed to the bottom of the curtain and passing vertically through guides fixed at regular intervals along the curtain;

a horizontally extending belt-winding shaft disposed over the top of the door and connected to said belts;

an electric motor and brake unit drivably connected to the shaft and comprising an electric motor means and an electric brake means;

manual means actuatable for disengaging the brake means of said motor and brake unit; and at least one counterweight means coupled through suspension means to a drum fixed on one end of the shaft;

wherein said counterweight means (1) raises the bottom of said curtain to a predetermined fraction of the curtain's height when said manual means is actuated and when said motor means of said motor and brake unit is out of operation, (2) prevents said curtain from completely closing and keeps it open to said predetermined fraction of the curtain's height when said shaft is accidentally disconnected from said motor and brake unit, and (3) cooperates with said motor means when said motor means operates, said predetermined fraction of the curtain's height being substantially equal to the height of a human being, and wherein said brake means brakes said belt-winding shaft when said motor means does not operate.

2. A device according to claim 1, wherein said counterweight means freely moves inside a counterweight housing, and wherein at least one of the door risers is constituted by a first channel-section bar having sidewalls, and wherein the counterweight housing has a closed hollow rectangular cross-section and is constituted by a second channel-section bar secured to one of said sidewalls.

3. A device according to claim 1, wherein said counterweight means freely moves inside a counterweight housing, and wherein at least one of the door risers is constituted by a first channel-section bar having a bottom wall, and wherein the counterweight housing has a closed rectangular cross section and is constituted by a second channel-section bar secured to said bottom wall.

* * * * *